United States Patent [19]

Ooho

[11] 4,270,819

[45] Jun. 2, 1981

[54] COLD DISPLAY CASE

[76] Inventor: Morihei Ooho, 303-1, Ohaza Honjo, Yahata Nishi-ku, Kitakyushu, Fukuoka Prefecture, Japan

[21] Appl. No.: 39,557

[22] Filed: May 16, 1979

[30] Foreign Application Priority Data

Jul. 21, 1978 [JP] Japan ..... 53/101228[U]

[51] Int. Cl.[3] ..... A47F 3/04

[52] U.S. Cl. ..... 312/116; 62/255; 312/140; 312/236

[58] Field of Search ..... 312/116, 117, 140, 236, 312/257 R, 257 SK; 62/255, 256

[56] References Cited

U.S. PATENT DOCUMENTS

| | | | |
|---|---|---|---|
| 2,494,703 | 1/1950 | Greiling | 312/116 |
| 2,708,349 | 5/1955 | Kuhn | 62/255 |
| 3,044,656 | 7/1962 | Combs | 312/257 SK |
| 3,647,274 | 3/1972 | Schnelle | 312/257 SK |
| 3,729,243 | 4/1973 | Musgrave et al. | 312/116 |

*Primary Examiner*—Casmir A. Nunberg

*Attorney, Agent, or Firm*—Wenderoth, Lind & Ponack

[57] ABSTRACT

A cold display case which can be assembled easily and quickly on the spot without particular specialized skill is provided. Frames for the cold display case are constructed with generally rectangular pipes and connectors, said connectors each having a main body and a plurality of engaging arms crossing at right angles to each other.

6 Claims, 10 Drawing Figures

FIG. 1
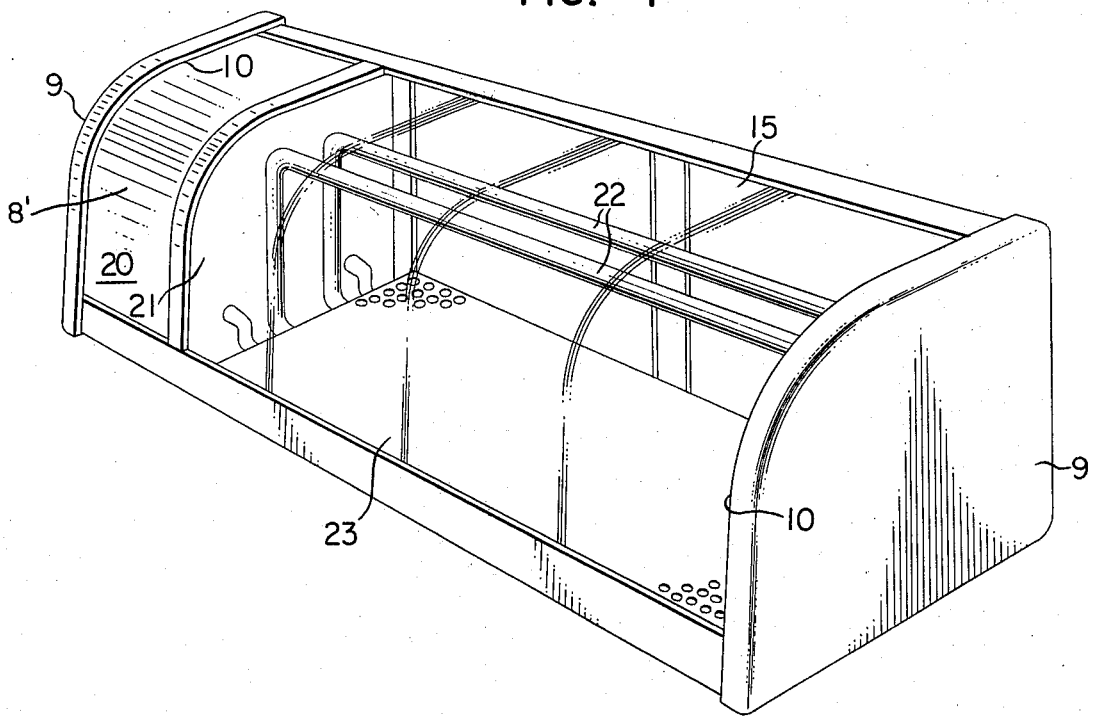
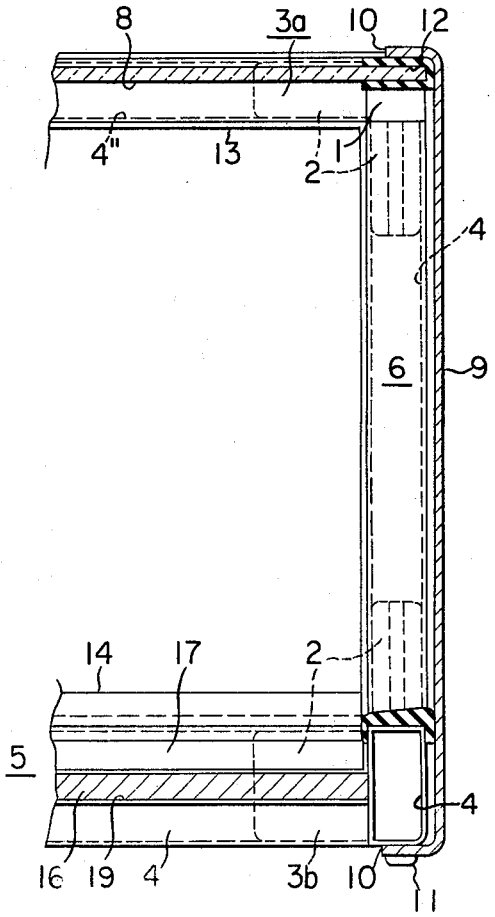
FIG. 3

COLD DISPLAY CASE

BACKGROUND OF THE INVENTION

1. Field of the Invention

This invention relates to a cold display case for displaying perishable foods like raw fish, meat, vegetables and so on, and any other food like ice-box cakes and ice cream which must be refrigerated, and more particularly to the construction of the case which is simple and easily assembled.

2. Description of the Prior Art

To constitute a cold display case, heretofore, stainless steel sections have been welded together to form frames, so that has required a great effort and a great deal of skill to assemble a bottom plate supporting frame and a sliding glass door frame. Therefore it has been difficult to improve production efficiency and to assemble the product on the spot.

SUMMARY OF THE INVENTION

It is an object of the invention to provide a cold display case which can be assembled easily and quickly on the spot without particular skill.

In accordance with the present invention, a cold display case is provided in which the frames thereof are constructed of steel pipes and connectors for assembling said pipes so that said frames can be easily and quickly constructed without necessitating other connecting means like welding. This invention generally resides in the cold display case which comprises a bottom plate supporting frame, a sliding glass door frame, said frames being constructed with generally rectangular pipes and connectors and said connectors each having a main body and a plurality of engaging arms crossing at right angles to each other, packings attached along the upper surface of a front rectangular pipe of said bottom plate supporting frame and along the front surface of an upper rectangular pipe of said sliding glass door frame, a curved glass plate supported by said packings by inserting the upper and lower ends thereof into grooves formed in said packings, and side cover plates for covering the ends of both said glass plate and said frames, interposing packings between said side cover plates and said glass plate and said frames respectively.

BRIEF DESCRIPTION OF THE DRAWINGS

The above brief description, as well as further objects, features and advantages of the present invention, will be more fully understood by reference to the following detailed description of the presently preferred, but nonetheless illustrative, embodiment in accordance with the present invention when taken in conjunction with the accompanying drawings, wherein:

FIG. 1 is a perspective view of a preferred embodiment of a cold display case of the present invention;

FIG. 3 is a partial sectional front view of the cold display case shown in FIG. 1;

DESCRIPTION OF THE PREFERRED EMBODIMENT

Figure 2:
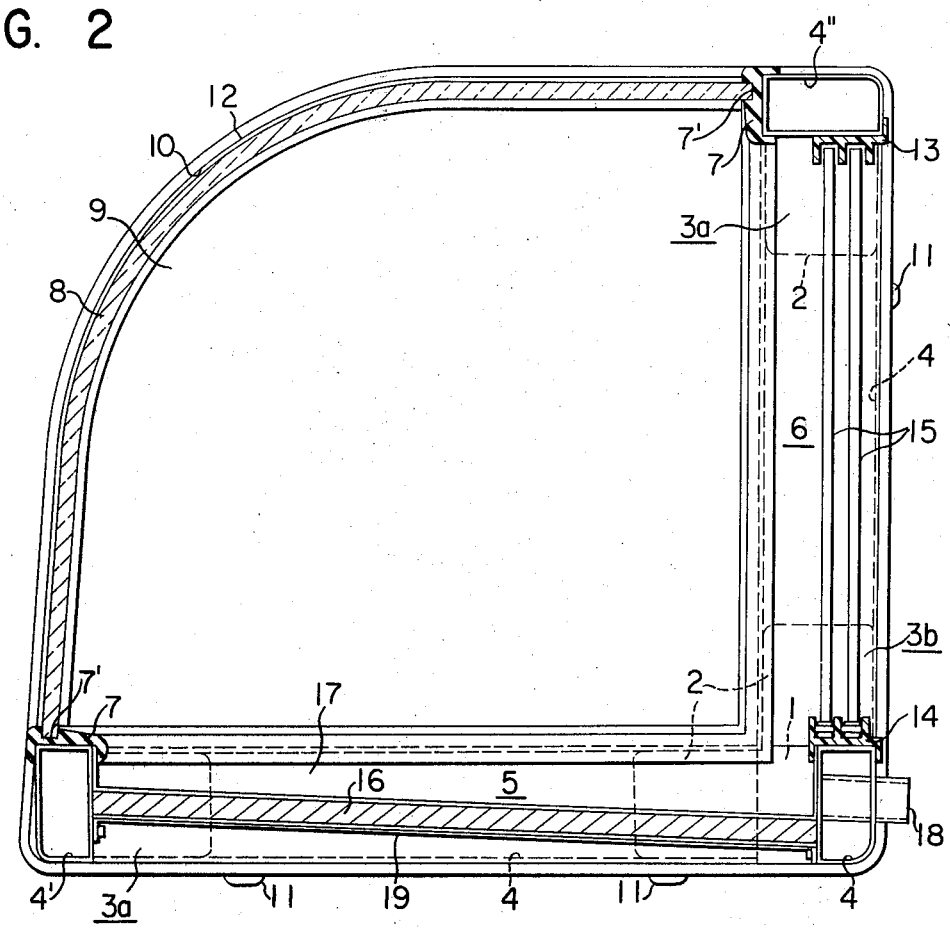
FIG. 2 is a sectional side view of the cold display case shown in FIG. 1.
Figure 4:
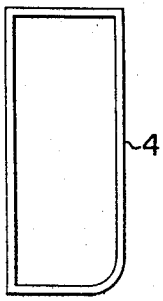
FIG. 4 is an end view of a rectangular pipe.
Figure 5:
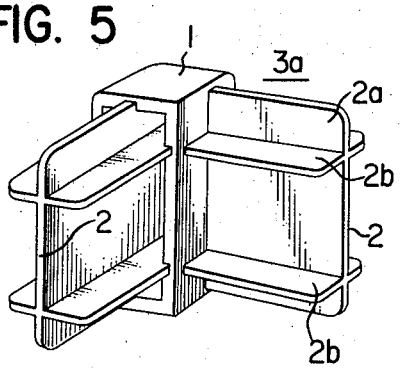
FIG. 5 is a perspective view of a connector having two arms.
Figure 6:
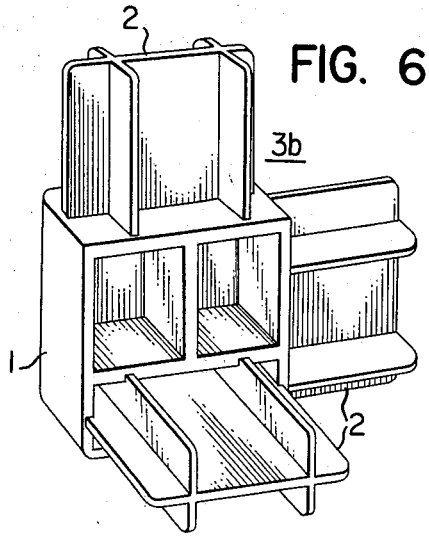
FIG. 6 is a perspective view of a connector having three arms.
Figure 8:
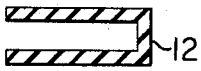

Referring now to FIGS. 1 and 2 of the drawings, a cold display case according to the present invention has two chambers, a larger one for displaying foods in cold storage so that this chamber has a curved glass plate at the front side and sliding glass doors 15 at the rear side and also has refrigerating pipes 22 extending therein, and a smaller chamber 20 for accommodating a refrigerating machine. Chamber 20 is covered so as not to be seen from the outside. This cold display case is generally constituted of frames, glass plates, side covers and a bottom plate. Both a sliding glass door frame 6 and a bottom plate supporting frame 5 are formed using connectors 3*a* and 3*b*, having a main body 1 and a plurality of engaging arms 2 crossing at right angles to each other, and generally rectangular pipes 4 (shown in FIG. 4) engageable with the arms 2. Packings 7 and 7 are attached using adhesives along the upper surface of a front rectangular pipe 4′ forming the bottom plate supporting frame 5 and along the front surface of an upper rectangular pipe 4″ forming the sliding glass door frame 62. The upper and lower ends of a curved front glass plate 8 are respectively inserted into grooves 7′ and 7′ formed on the packings 7 and 7. Both side ends of the glass plate 8 and the frames 5 and 6 are covered with side cover plates 9 interposing a packing 12 (shown in FIG. 8) therebetween. The connectors 3*a* and 3*b* as shown in FIGS. 5 and 6, are made of cured plastics and have a main body 1, which is generally a rectangular parallelopipedon, and two or three arms 2. The arm 2 is constituted of a plate portion 2*a* and two plate portions 2*b* crossing the plate portion 2*a* at right angles thereby forming a rectangular shape corresponding to that of pipe 4 with the outer peripheries thereof to be engageable with the pipe 4. The connectors 3*b* having three arms 2, as shown in FIG. 6, are used at the corners for connecting the frames 5, and 6, while the connectors 3*a* having two arms 2, as shown in FIG. 5, are used at the corners of the frames 5 and 6 other than at the above mentioned corners.

Figure 7:
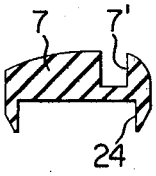
FIGS. 7 and 8 are sectional views of packing.
Figure 9:
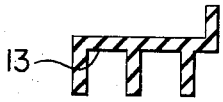
FIG. 9 is a sectional view of a lintel.
Figure 10:
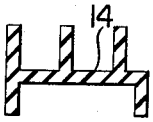
FIG. 10 is a sectional view of a doorsill.

The packing 7, as shown in FIG. 7, has the groove 7′ on the front surface thereof and a groove 24 for accepting the rectangular pipe on the back surface thereof. The side cover plate 9 made of transparent plastic plate has a bent edge 10 on the outer periphery thereof, with which the periphery of each of the glass plate 8 and the frames 5 and 6 is engaged, and is fixed by adhesive and screws 11. Sliding glass doors 15 are slidably guided between a lintel 13 (shown in FIG. 9) and doorsill 14 (shown in FIG. 10) which are mounted on the upper rectangular pipe 4′ and the lower rectangular pipe 4 respectively. A bottom plate 16 is supported by a support plate 19 between the pipes 4 and 4′ with a slight gradient, thereby forming a tank 17 which has a drain pipe 18. Disposed above the tank 17 is a food support plate 23. A refrigerating machine (not shown) is disposed in the refrigerating machine chamber 20 which is separated from the display chamber by a wall 21. Refrigerating pipes 22 extend into the display chamber from the refrigerating machine chamber 20. An opaque curved front cover plate 8′ is affixed to the front of the refrigerating machine chamber 20.

It will now be apparent that according to this invention a cold display case can be constructed easily and quickly on the spot without particular skill by carrying the rectangular pipes, connectors, packings, side cover plates, glass doors and other parts to the spot and assemblying them.

As will be readily apparent to those skilled in the art, the present invention may be realized in other specific forms without departing from its spirit or essential characteristics. The present embodiment is, therefore, to be considered as illustrative and not restrictive, the scope of the invention being indicated by the claims rather than by the foregoing description, and all changes which come within the meaning and range of equivalents of the claims are therefore intended to be embraced therein.

What is claimed is:

1. A cold display case, wherein the frames thereof are constructed of steel pipes and connectors for assembling said pipes so that said frames can be easily and quickly constructed without necessitating other connecting means like welding;

wherein said pipes are generally rectangular and said connectors each have a main body and a plurality of engaging arms which engage said pipes and cross at right angles to each other;

and wherein said case comprises;

a bottom plate supporting frame, a sliding glass door frame, said frames being constructed with generally rectangular pipes and connectors, and said connectors each having a main body and a plurality of engaging arms crossing at right angles to each other, packings attached along the upper surface of a front rectangular pipe of said bottom plate supporting frame and along the front surface of an upper rectangular pipe of said sliding glass door frame, a curved glass plate supported by said packings by inserting the upper and lower ends thereof into grooves formed on said packings, and side cover plates for covering the ends of both said glass plate and said frames, interposed packings between said cover plates on the one hand and said glass plate and said frames respectively on the other hand.

2. A cold display case as claimed in claim 1 wherein said rectangular pipes are rectangular stainless steel pipes, one corner of each of said pipes, being rounded.

3. A cold display case comprising:

a bottom plate supporting frame and a sliding glass door frame, each of said frames comprising a plurality of pipes of rectangular cross section connected together at right angles by a plurality of connectors, each of said connectors having a main body and a plurality of orthogonal engaging arms for engaging said pipes, said frames connected together by said connectors;

a plurality of packings having a plurality of grooves and affixed to an upper surface of a front pipe of said bottom plate supporting frame and a front surface of said sliding glass door frame;

a pair of side cover plates connected to said bottom plate supporting frame and sliding glass door frame;

a curved front glass plate and a curved front cover plate arranged within said grooves of said packings between said bottom plate supporting frame and said sliding glass door frame and between said pair of side cover plates;

a lintel and doorsill, each having grooves therein and affixed to opposite pipes of said sliding glass door frame;

a plurality of sliding doors affixed within said grooves of said lintel and doorsill, wherein said curved front glass plate and said front cover plate and said bottom plate supporting frame and said sliding doors form a columnar shaped volume;

a wall plate parallel to said pair of side cover plates arranged between said curved front glass plate and said curved front cover plate whereby said case is divided into two chambers, a first display chamber having the curved front glass plate as one surface of its volume and a refrigerating machine chamber having said curved front cover plate as one surface of its volume.

4. A cold display case as in claim 3, wherein said plurality of pipes are of stainless steel and wherein one corner of said rectangular cross section thereof is rounded.

5. A display case as in claim 3, further comprising a bottom plate affixed to said bottom plate supporting frame.

6. In a cold display case having a columnar volume, sliding glass doors, a curved front face comprising a curved opaque front cover plate and curved front glass display plate, the improvement comprising:

a bottom plate supporting frame and a sliding glass door frame formed of a plurality of pipes having rectangular cross sections and interconnected by a plurality of connectors, each connector having a plurality of orthogonal engaging arms for engaging with said pipes;

wherein said pipes and connectors may be attached to each other with adhesives to thereby enable the transporting of said display case in a disassembled state and to thereby enable its assembly in situ.

* * * * *